US005931706A

United States Patent [19]

Bassi

[11] Patent Number: 5,931,706

[45] Date of Patent: Aug. 3, 1999

[54] MONOLITHIC TERMINAL BOARD-CABLE ASSEMBLY, IN PARTICULAR FOR THE ELECTRIC SUPPLY OF ELECTRIC HOUSEHOLD APPLIANCES

[75] Inventor: Alberto Bassi, Turin, Italy

[73] Assignee: ITW Fastex Italia S.p.A., Turin, Italy

[21] Appl. No.: 08/998,674

[22] Filed: Dec. 29, 1997

[30] Foreign Application Priority Data

Dec. 27, 1996 [IT] Italy ..... TO96U0267

[51] Int. Cl.[6] ..... H01R 13/514

[52] U.S. Cl. ..... 439/731; 439/467; 411/403

[58] Field of Search ..... 411/403, 402, 411/404, 405, 406, 409; 439/76.1, 465, 467, 731, 595, 596

[56] References Cited

U.S. PATENT DOCUMENTS

| | | | |
|---|---|---|---|
| 3,134,292 | 5/1964 | Walton | 411/403 |
| 3,253,625 | 5/1966 | Oestereicher | 411/403 |
| 3,331,274 | 7/1967 | Walton | 411/403 |
| 3,673,912 | 7/1972 | Herr | 411/403 |
| 5,219,242 | 6/1993 | Liaw | 439/467 |
| 5,871,374 | 2/1999 | Maney | 439/596 |

FOREIGN PATENT DOCUMENTS 92000302 of 0000 Italy .

*Primary Examiner*—Christopher A. Bennett
*Attorney, Agent, or Firm*—Schwartz & Weinrieb

[57] ABSTRACT

A terminal board-cable assembly has an electric supply cable, and a boxlike terminal board molded from synthetic plastic material and defined by a base having at least one electric contact projecting from a first face of the base, and by a cover which is able to be locked to the base against a second face of the base opposite the first base. The cable is inserted and fixed removably fixed inside the boxlike terminal board, and has at least one conducting wire connected to the electric contact. The cover was connected non-removably to the base by at least one screw fitted through the cover, and having the head recessed inside a seat on the cover, and a shank threaded inside a threaded dead seat on the base. The screw is a one-way type, fastener, that is, one having a head with a gripping member only enabling the screw to be rotated in the threading direction, so that the screw, once threaded inside the seat, cannot be unscrewed, thus making the assembly monolithic in the same way as a pressure molded assembly.

24 Claims, 1 Drawing Sheet

MONOLITHIC TERMINAL BOARD-CABLE ASSEMBLY, IN PARTICULAR FOR THE ELECTRIC SUPPLY OF ELECTRIC HOUSEHOLD APPLIANCES

FIELD OF THE INVENTION

The present invention relates to an integral terminal board-cable assembly, that is, wherein the terminal board is only separable from the cable by disabling the assembly. Assemblies of this sort, which define an actual non-separable functional unit, are especially suitable for the electric supply of electric household appliances.

BACKGROUND OF THE INVENTION

Integral terminal board-cable assemblies of the above type have been known for some time, and, similarly integral plug-cable assemblies, which have also been known for many years, the plastic terminal board is molded onto the end portion of the supply cable comprising the terminals and respective contacts.

For household appliance manufacturers and user devices in general, such assemblies have the advantage of simplifying the wiring of the appliance, by simply clicking the terminal board inside its seat and connecting the user device directly to the terminal board connectors already positioned and supplied by the cable.

On the other hand, "integral" assemblies of this sort also involve two major drawbacks. First is the difficulty involved in molding the terminal board onto the cable, which, to ensure the necessary adhesion, means prefitting the cable with a polyamide insert, thus resulting in a fairly long production cycle and high end cost. Second, unless the maker also produces electric cable, is the impossibility on the part of the maker of achieving adequate scale economy, and the dependence of the user device on one supplier, which inevitably means higher cost, only partly compensated for by the lower cost of wiring the appliance.

To overcome the above drawbacks, Italian Utility Model Patent Application No. T092U000302 was filed by the present Applicant on Dec. 22, 1992. This patent application describes an integral assembly in which a cable is connected to terminals comprising blade contacts, which are clicked through seats in the base of a plastic terminal board having a hinged cover which clicks onto and grips the base so as to grip the cable inside a cable seat through the base and thereby cover the terminals and respective contacts in a fluidtight manner on the opposite side opposite to the through seats.

The terminal board, cable and contacts may therefore be produced separately and then fitted together to obtain an integrated unit substantially equivalent, in terms of mounting to the appliance, to a co-molded unit. The degree of safety, however, of such a unit is inferior to that of known co-molded units, by allowing the cover to be opened even after the unit is mounted to the appliance, for example, by removing the fasteners, which may be screws, click-in pins, or the like, securing the cover to the base. On the other hand, sealing the cover permanently to the base, for example, by means of adhesives, or subsequently incorporating the base and cover in a layer of resin are not practical solutions to the problem on account of the production problems involved and the cost of the necessary equipment.

OBJECT OF THE INVENTION

It is an object of the present invention to provide a terminal board-cable assembly such as the one described in the above patent application by the present Applicant, but which, once assembled, forms a monolithic whole similar to pressure molded assemblies, that is, one which may only be broken down into its original component parts by breaking one or more of the components and thereby disabling the assembly as a whole.

SUMMARY OF THE INVENTION

According to the present invention, there is provided a monolithic terminal board-cable assembly, in particular for the electric supply of electric household appliances, comprising an electric supply cable having at least one conducting wire; and a boxlike terminal board made of electrically insulating material and in turn comprising a base having at least one electrical contact projecting from a first face of the base and connected to the conducting wire, and a cover lockable to the base against a second face of the base opposite the first base, the cable being inserted into and removably secured inside the boxlike terminal board; characterized in that the cover is non-removably connected to the base by means of at least one one-way screw inserted inside a seat on the boxlike terminal board; the screw having means only allowing rotation of the screw inside the seat in the threading direction, so that the screw, once threadedly secured inside the seat, cannot be unscrewed, thus making the assembly monolithic.

More specifically, the screw has a head having a gripping member only permitting the screw to be torqued in the threading direction of the screw; and the seat is so formed that the screw, once tightened, is fully recessed, including the head, inside the seat on the boxlike terminal board.

The assembly according to the invention may thus be assembled using commonly used fastener-driving tools, while at the same time ensuring it is completely monolithic once it is assembled. That is, once fully threaded in a non-projecting manner inside the seat, the screw can in no way be gripped and unscrewed using tools or pliers, so that the assembly is sealed just like a conventional assembly with a co-molded terminal board. In both cases, in fact, the supply cable can only be detached by destroying the terminal board and thereby disabling the assembly.

BRIEF DESCRIPTION OF THE DRAWINGS

A non-limiting embodiment of the present invention will be described by way of example in the following detailed description with reference to the accompanying drawings, in which.

DETAILED DESCRIPTION OF THE PREFERRED EMBODIMENT

Figure 1:
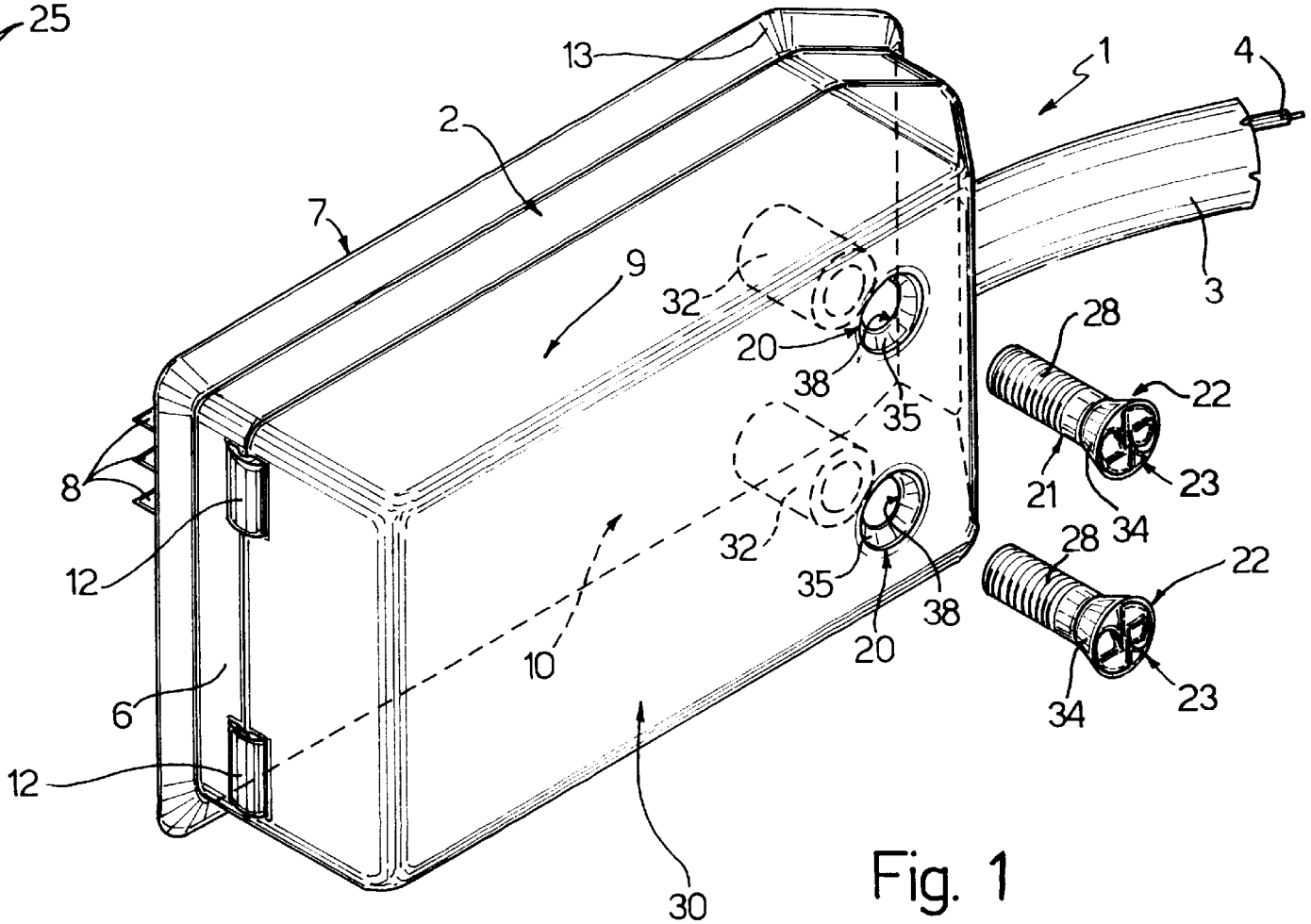
FIG. 1 is a schematic, partially exploded view in perspective of a monolithic terminal board-cable assembly constructed in accordance with the present invention.
Figure 2:
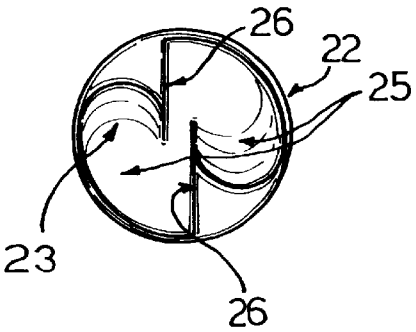
FIG. 2 is a larger-scale top plan view of a fastener component of the FIG. 1 assembly.

With reference to FIGS. 1 and 2, number 1 indicates a monolithic assembly comprising a boxlike terminal board 2, and an electric supply cable 3. Assembly 1 may be used for electrically supplying electric household appliances, and is formed as described in Italian utility model patent application No. T092U000302 filed on Dec. 22, 1992 and entitled "TERMINAL BOARD-CABLE ASSEMBLY, IN PARTICULAR FOR THE ELECTRIC SUPPLY OF ELECTRIC HOUSEHOLD APPLIANCES", the content of which is incorporated herein purely as required by way of reference.

In particular, electric cable 3 has at least one known insulated conducting wire 4, although it is conventionally known that cable 3 normally has more than one wire 4; and the boxlike terminal board, which is made of electrically insulating material, such as, for example, molded from synthetic plastic material, comprises a flat base 6, from a first face 7 of which projects at least one known electrical contact 8, although in the illustrated example, more than one contact 8 is shown connected in a known manner, inside boxlike terminal board 2, to conducting wire 4. For example, base 6 has a plurality of contacts 8 connected variously to one another and to the wires of cable 3, and which are defined, for example, by Faston type blade connectors fitted through seats (not shown) in base 6.

Terminal board 2 also comprises a cover 9 which is capable of being locked to base 6 against a second face 10 of the base 6 which is opposite face 7, so as to cover the electrical connections of contacts 8 and wires 4 of cable 3 and the end portion of cable 3, which end portion is thus inserted inside boxlike terminal board 2, inside which, cable 3 is removably fixed, for example, by means of a known cable clamping device (not shown) formed integrally with cover 9, on the inner side of the cover facing face 10 of base 6, or on base 6.

Cover 9 may be formed integrally in one piece with base 6, and is hinged to one end of the base 6 by means of plastic hinges defined by flexible tongues 12; and base 6 is defined, towards face 7, by a flexible, suction cup type edge 13 by which to click the base, by means of appropriate teeth and known elastic tongues (not shown), to the casing of a user device, for example, a household appliance for electric supply thereto.

According to the invention, cover 9, which may comprise known fastening means for click-on mounting to base 6, is non-removably connected to the base 6 by means of at least one one-way screw 21 inserted inside a seat 20 on boxlike terminal board 2. More specifically, in the example shown, cover 9 is non-removably mounted against face 10 of base 6 by means of two screws 21 housed inside two seats 20 located symmetrically with respect to the longitudinal axis of boxlike terminal board 2 and close to cable 3, that is, at the end of board 2 which is opposite to tongues 12.

In this position, screws 21 may also be used for gripping cable 3 inside boxlike terminal board 2, in the event, for example, cover 9 or base 6 is formed in one piece with the cable clamping device (not shown), so that tightening screws 21 provides simultaneously for closing boxlike terminal board 2 and clamping cable 3.

The screws 21 used according to the present invention are characterized by comprising means only enabling the screws to be rotated inside seats 20 in the threading direction, so that, once threaded inside a respective seat 20, each screw 21 cannot be unscrewed, thus making assembly 1 monolithic. Obviously, even though cable 3 is connected to contacts 8 in a conventional, that is removable, manner, once cover 9 is non-removably mounted to face 10 of base 6 by means of screws 21, the terminals of cable 3 may only be reached to detach the cable by breaking terminal board 2. Despite comprising a number of parts fitted together, assembly 1 as described therefore provides for the same degree of safety as a conventional assembly in which the terminal board is pressure molded onto cable 3.

More specifically, the non-limiting embodiment shown employs commercial screws 21, each having a head 22 with a gripping member 23 only enabling the screw to be torqued in the threading direction of the screw. As shown in FIG. 2, the gripping member 23 is defined by a particular formation or extrudable of the upper surface of head 22, in which are formed two partially helical cavities 25 defined by inclined surfaces and terminating with respective opposite radial shoulders 26. Using an appropriately shaped tool, screw 21 may therefore only be torqued by pushing against shoulders 26, whereas, in the opposite direction, the tool (or any other tool or pliers) slides over the curved inclined surfaces defining cavities 25.

In a preferred embodiment of the invention, in order to lock cover 9 even more securely to base 6, seat 20 of each screw 21 is so formed that the screw 21, once tightened, is recessed entirely, including head 22, inside the seat 20, so that screws 21 cannot even be torqued by gripping heads 22 from the outside, for example, by using a pliers or similar tool.

In the preferred embodiment shown, each screw 21 comprises a head 22 and a normally threaded shank 28, and is fitted through cover 9 with head 22 recessed inside a seat 20 formed through cover 9, and either flush with an outer surface 30 of cover 9 or inside seat 20, but never outside the seat 20; and shank 28 is screwed inside a threaded dead seat or blind base 32 integral with base 6 and formed on face 10 of the base 6.

Moreover, head 22 of each screw 21 and respective seat 20 in cover 9 are so formed as to comprise respective opposite surfaces 34, 35 frictionally cooperating with each other. More specifically, head 22 of each screw 21 has a truncated-cone-configuration, flaring away from shank 28, and has a profile reproducing the respective seat 20 in the cover 9, which, in the example shown, is defined by a truncated-cone-shaped cavity flaring outwards and terminating with a through hole 38 so as to enable shank 28 to engage respective threaded seat 32.

The above arrangement, by increasing the unscrewing as compared with the threading torque, further ensures against screws 21 being unscrewed.

Clearly, the location of screws 21 may be other than as shown; and screws 21, as opposed to being fitted through cover 9 as shown in FIG. 1, may be fitted through base 6—in which case, seats 20 would be formed in the base 6—and threaded inside respective threaded seats 32 integral with an inner face of cover 9.

Obviously, many modifications and variations of the present invention are possible in light of the above teachings. It is therefore to be understood that within the scope of the appended claims, the present invention may be practiced otherwise than as specifically described herein.

I claim:

1. A monolithic terminal board-cable assembly, comprising:

an electric supply cable having at least one electrically conducting wire;

a boxlike terminal board made of electrically insulating material and comprising a base member having first and second opposite faces, first and second opposite ends, and at least one electrical contact projecting away from said first face of said base member and connected to said at least one electrically conducting wire; and a cover member, having first and second opposite ends corresponding to said first and second opposite ends of said base member, hingedly mounted at said first end thereof upon said first end of said base member and upon said second face of said base member;

a first seat defined within said second end of a first one of said base and cover members of said terminal board and protecting away from said first one of said base and cover members of said terminal board so as to extend toward a second one of said base and cover members of said terminal board;

a second seat defined within said second end of said second one of said base and cover members of said terminal board;

means for fixedly securing said electric supply cable inside said terminal board; and one-way fastener means mounted within said first seat, defined within said second end of said first one of said base and cover members of said terminal board, and within said second seat defined within said second end of said second one of said base and cover members of said terminal board, for non-removably securing said cover member of said terminal board to said base member of said terminal board by allowing rotation of said one-way fastener means only in one direction so that said one-way fastener means, once mounted within said first and second seats of said base and cover members of said terminal board, cannot be unfastened and removed from said terminal board thereby rendering said terminal board-cable assembly monolithic.

2. A terminal board-cable assembly as claimed in claim 1, wherein said screw has a head having gripping means for permitting screw to be torqued only in the threading direction of said screw; and said first and second seats are formed within said cover and said base of said terminal board such that said screw, once tightened, is fully recessed, including said head, inside said seats formed upon said cover and said base of said terminal board.

3. A terminal board-cable assembly as claimed in claim 2, wherein said screw comprises said head and a shank; and one of said first and second seats of said cover and said base of said terminal board comprises a recessed seat for accommodating said head of said screw in a recessed manner when said screw is threadedly inserted into said terminal board whereby said head of said screw is at least flush with an outer, surface of one of said cover and said base of said terminal board, and the other one of said first and second seats of said, cover and said base of said terminal board comprises a threaded blind bore for accommodating said threaded shank of said screw when said screw is threadedly inserted into said terminal board.

4. A terminal board-cable assembly as claimed in claim, 3, wherein said head and said one of said first and second seats of said cover and said said base of said terminal board for accommodating said head of said screw are formed so as to comprise respective opposite complementary surfaces frictionally cooperating together.

5. A terminal board-cable assembly as claimed in claim 4, wherein said head of said screw has a truncated-cone-shaped configuration flaring away from said shank; and comprises a truncated-cone-shaped cavity flaring outwards and terminating at its diametrically smaller end with a through hole for said shank of said screw.

6. A terminal board-cable assembly as claimed in claim 1, wherein said terminal board has a longitudinal extent comprising a longitudinal axis; and said cover is connected to said base by at least two one-way screws located symmetrically with respect to said longitudinal axis of said terminal board and at the same end of said terminal board at which said cable is connected to said terminal board.

7. A terminal board-cable assembly as claimed in claim 1, wherein:

said terminal board is made from molded synthetic plastic material.

8. A terminal board-cable assembly as set forth in claim 1, wherein:

said one-way fastener means comprises a one-way threaded screw.

9. A terminal board-cable assembly as set forth in claim 3, wherein:

said recessed seat comprising said one of said first and second seats of said cover and said base of said terminal board is disposed upon said first face of said base when said one of said first and second seats of said cover and said base is disposed upon said base, and is disposed upon an outer face of said cover when said one of said first and second seats of said cover and said base is disposed upon said cover; and said threaded blind bore comprising said other one of said first and second seats of said cover and said base of said terminal board is disposed upon a second face of said base when said other one of said first and second seats of said cover and said base is disposed upon said base, and is disposed upon an inner face of said cover when said other one of said first and second seats of said cover and said base is disposed upon said cover.

10. A terminal board-cable assembly as set forth in claim 1, further comprising:

hinge means integrally formed with said base and said cover of said terminal board for hingedly connecting said cover to said base of said terminal board.

11. A terminal board-cable assembly as set forth in claim 2, wherein:

said gripping means of said head of said screw comprises a pair of diametrically opposed radial shoulders against which a torquing tool can exert threading torque, and a pair of diametrically opposed helical cavities comprising inclined surfaces over which the torquing tool slides so as to be incapable of generating unthreading torque.

12. A monolithic terminal board-cable assembly, comprising:

an electric supply cable having at least one electrically conducting wire;

a boxlike terminal board made of electrically insulating material and comprising a base member having first and second opposite faces, first and second opposite ends, and at least one electrical contact projecting away from said first face of said base member and connected to said at least one electrically conducting wire; and a cover member, having first and second opposite ends corresponding to said first and second opposite ends of said base member, hingedly mounted at said first end thereof upon said first end of said base member and upon said second face of said base member;

a first seat defined within said second end of a first one of said base and cover members of said terminal board and projecting away from said first one of said base and cover members of said terminal board so as to extend toward a second one of said base and cover members of said terminal board;

a second seat defined within said second end of said second one of said base and cover members of said terminal board;

means for fixedly securing one end of said electric supply cable within said terminal board; and permanently secured fastener means mounted within said first seat, defined within said second end of said first one of said base and cover members of said terminal board, and within said second seat defined within said second end of said second one of said base and cover members of said terminal board, for non-removably securing said cover member of said terminal board to said base member of said terminal board such that said permanently secured fastener means, once mounted within said first and second seats of said base and cover members of said terminal board, cannot be unfastened and removed from said terminal board thereby rendering said terminal board-cable assembly monolithic.

13. A terminal board-cable assembly as set forth in claim 12, wherein:

said permanently secured fastener means comprises a one-way threaded screw.

14. A terminal board-cable assembly as claimed in claim 13, wherein:

said screw has a head having gripping means for permitting said screw to be torqued only in the threading direction of said screw; and said first and second seats are formed within said cover and said base of said terminal board such that said screw, once tightened, is fully recessed, including said head, inside said seats formed upon said cover and said base of said terminal board.

15. A terminal board-cable assembly as claimed in claim 14, wherein:

said screw comprises said head and a shank; and one of said first and second seats of said cover and said base of said terminal board comprises a recessed seat for accommodating said head of said screw in a recessed manner when said screw is threadedly inserted into said terminal board whereby said head of said screw is at least flush with an outer surface of one of said cover and said base of said terminal board, and the other one of said first and second seats of said cover and said base of said terminal board comprises a threaded blind bore for accommodating said threaded shank of said screw when said screw is threadedly inserted into said terminal board.

16. A terminal board-cable assembly as set forth in claim 15, wherein:

said recessed seat comprising said one of said first and second seats of said cover and said base of said terminal board is disposed upon said first face of said base when said one of said first and second seats of said cover and said base is disposed upon said base, and is disposed upon an outer face of said cover when said one of said first and second seats of said cover and said base is disposed upon said cover; and said threaded blind bore comprising said other one of said first and second seats of said cover and said base of said terminal board is disposed upon a second face of said base when said other one of said first and second seats of said cover and said base is disposed upon said base, and is disposed upon an inner face of said cover when said other one of said first and second seats of said cover and said base is disposed upon said cover.

17. A terminal board-cable assembly as claimed in claim 15, wherein:

said head and said one of said first and second seats of said cover and said said base of said terminal board for accommodating said head of said screw are formed so as to comprise respective opposite complementary surfaces frictionally cooperating together.

18. A terminal board-cable assembly as claimed in claim 17, wherein:

said head of said screw has a truncated-cone-shaped configuration flaring away from said shank; and said seat comprises a truncated-cone-shaped cavity flaring outwards and terminating at its diametrically smaller end with a through hole for said shank of said screw.

19. A terminal board-cable assembly as claimed in claim 13, wherein:

said terminal board has a longitudinal extent comprising a longitudinal axis; and said cover is connected to said base by at least two one-way screws located symmetrically with respect to said longitudinal axis of said terminal board and at the same end of said terminal board at which said one end of said cable is connected to said terminal board.

20. A terminal board-cable assembly as claimed in claim 12, wherein:

said terminal board is made from molded synthetic plastic material.

21. A terminal board-cable assembly as set forth in claim 12, further comprising:

hinge means integrally formed with said base and said cover of said terminal board for hingedly connecting said cover to said base of said terminal board.

22. A terminal board-cable assembly as set forth in claim 14, wherein:

said gripping means of said head of said screw comprises a pair of diametrically opposed radial shoulders against which a torquing tool can exert threading torque, and a pair of diametrically opposed helical cavities comprising inclined surfaces over which the torquing tool slides so as to be incapable of generating unthreading torque.

23. A monolithic terminal board-cable assembly, comprising:

an electric supply cable having at least one electrically conducting wire;

a boxlike terminal board made of electrically insulating material and comprising a base member having first and second opposite faces, first and second opposite ends, and at least one electrical contact projecting away from said first face of said base member and connected to said at least one electrically conducting wire; and a cover member, having first and second opposite ends corresponding to said first and second opposite ends of said base member, hingedly mounted at said first end thereof upon said first end of said base member and upon said second face of said base member;

a first seat defined within said second end of a first one of said base and cover members of said terminal board and projecting away from said first one of said base and cover, members of said terminal board so as to extend toward a second one of said base and cover members of said terminal board;

a second seat defined within said second end of said second one of said base and cover members of said terminal board;

means for fixedly securing one end of said electric supply cable within said terminal board; and non-removable fastener means mounted within said first seat, defined within said second end of said first one of said base and cover members of said terminal boards and within said second seat defined within said second end of said second one of said base and cover members of said terminal board, for non-removably securing said cover member of said terminal board to said base member of said terminal board such that said non-removable fastener means, once mounted within said first and second seats of said base and cover members of said terminal board, cannot be unfastened and removed from said terminal board thereby rendering said terminal board-cable assembly monolithic.

24. A terminal board-cable assembly as set forth in claim 23, wherein:

said non-removable fastener means comprises a one-way threaded screw.

* * * * *